US009611646B2

(12) United States Patent
Martin et al.

(10) Patent No.: US 9,611,646 B2
(45) Date of Patent: Apr. 4, 2017

(54) CONNECTION MECHANISMS FOR STRUCTURAL MEMBERS AND RELATED ASSEMBLIES AND METHODS

(71) Applicant: RAPID FABRICATIONS IP LLC, Sims, NC (US)

(72) Inventors: Russell Martin, Sims, NC (US); Jack D. Stone, Sims, NC (US)

(73) Assignee: Rapid Fabrications IP, LLC, Sims, NC (US)

( * ) Notice: Subject to any disclaimer, the term of this patent is extended or adjusted under 35 U.S.C. 154(b) by 0 days.

(21) Appl. No.: 14/928,588

(22) Filed: Oct. 30, 2015

(65) Prior Publication Data

US 2016/0123010 A1 May 5, 2016

Related U.S. Application Data

(60) Provisional application No. 62/073,222, filed on Oct. 31, 2014.

(51) Int. Cl.

| | |
|---|---|
| ***E04C 2/38*** | (2006.01) |
| ***E04B 1/61*** | (2006.01) |
| *E04B 1/41* | (2006.01) |
| *E04C 2/00* | (2006.01) |

(52) U.S. Cl.

CPC ..... *E04C 2/38* (2013.01); *E04B 1/6125* (2013.01); *E04C 2002/001* (2013.01)

(58) Field of Classification Search

CPC ..... E04C 2/38; E04C 2002/001; E04B 1/6125
USPC ..... 52/586.1
See application file for complete search history.

(56) References Cited

U.S. PATENT DOCUMENTS

| | | | | |
|---|---|---|---|---|
| 6,681,820 | B2 * | 1/2004 | Olofsson | B23D 37/04 144/134.1 |
| 7,856,771 | B2 * | 12/2010 | Guidos | E06B 1/363 52/204.1 |
| 7,877,960 | B2 * | 2/2011 | Kennedy | B23K 33/00 52/592.1 |
| 8,516,767 | B2 * | 8/2013 | Engstrom | E04F 15/02 52/586.1 |
| 8,584,422 | B2 * | 11/2013 | Cobb | F16B 5/0068 52/582.2 |
| 8,950,908 | B2 * | 2/2015 | Berman | F21S 8/02 220/3.7 |
| 9,273,462 | B2 * | 3/2016 | Black | E04C 2/22 |

(Continued)

*Primary Examiner* — Charles A Fox
*Assistant Examiner* — Joseph J Sadlon
(74) *Attorney, Agent, or Firm* — Myers Bigel, P.A.

(57) ABSTRACT

A structural panel assembly includes first and second structural panels. Each structural panel includes: a substrate; an elongated male joint member comprising an aluminum extrusion at a first longitudinal edge portion of the substrate, with the male joint member including a latch member including a curved portion that extends the length of the substrate; and an elongated female joint member including an aluminum extrusion at a second, opposite longitudinal edge portion of the substrate, with the female joint member including a curved channel that extends the length of the substrate. The curved channel of the female joint member of the first structural panel is sized and configured to receive the latch member of the male female joint member of the second structural panel with the first and second structural panels in a coupled position.

8 Claims, 8 Drawing Sheets

(56) References Cited

U.S. PATENT DOCUMENTS

| | | | | |
|---|---|---|---|---|
| 2002/0108323 | A1* | 8/2002 | Gruber | A47G 27/0237 52/177 |
| 2005/0284058 | A1* | 12/2005 | Zeng | E04F 15/06 52/302.1 |
| 2009/0211175 | A1* | 8/2009 | Guidos | E06B 1/363 52/79.12 |
| 2009/0272056 | A1* | 11/2009 | Koupal | E04B 1/6162 52/309.4 |

* cited by examiner

CONNECTION MECHANISMS FOR STRUCTURAL MEMBERS AND RELATED ASSEMBLIES AND METHODS

BACKGROUND

There is an ongoing need for connection mechanisms for structural members (e.g., panels for roofs, floors and walls) that facilitate easy connection of the structural members without excessive tooling or fasteners and that provide a strong connection between the interconnected structural members.

SUMMARY

Some embodiments of the present invention are directed to a structural panel assembly. The assembly includes first and second structural panels. Each of the first and second structural panels includes: a substrate; an elongated male joint member including an aluminum extrusion at a first longitudinal edge portion of the substrate, with the male joint member including a latch member including a curved portion that extends the length of the substrate; and an elongated female joint member including an aluminum extrusion at a second, opposite longitudinal edge portion of the substrate, the female joint member including a curved channel that extends the length of the substrate. The curved channel of the female joint member of the first structural panel is sized and configured to receive the latch member of the male female joint member of the second structural panel with the first and second structural panels in a coupled position with the second longitudinal edge portion of the substrate of the first structural panel parallel to the first longitudinal edge of the substrate of the second structural panel.

Some other embodiments of the present invention are directed to a method of connecting structural panels. The method includes providing first and second structural panels. Each of the first and second structural panels includes: a substrate; an elongated male joint member comprising an aluminum extrusion at a first longitudinal edge portion of the substrate, with the male joint member including a latch member including a curved portion that extends the length of the substrate; and an elongated female joint member including an aluminum extrusion at a second, opposite longitudinal edge portion of the substrate, with the female joint member including a curved channel that extends the length of the substrate. The method includes: aligning the first and second structural panels such that an end of the latch member of the first structural panel is adjacent an entrance of the curved channel of the second structural panel; tilting the first structural panel in a first direction relative to the second structural panel such that the latch member is received in the curved channel; and tilting the first structural panel is a second, opposite direction relative to the second structural panel such that the first and second panels are connected in a coupled position with the first longitudinal edge portion of the substrate of the first structural panel parallel to the second longitudinal edge portion of the substrate of the second structural panel.

Further features, advantages and details of the present invention will be appreciated by those of ordinary skill in the art from a reading of the figures and the detailed description of the preferred embodiments that follow, such description being merely illustrative of the present invention.

DETAILED DESCRIPTION OF EMBODIMENTS OF THE INVENTION

Figure 1:
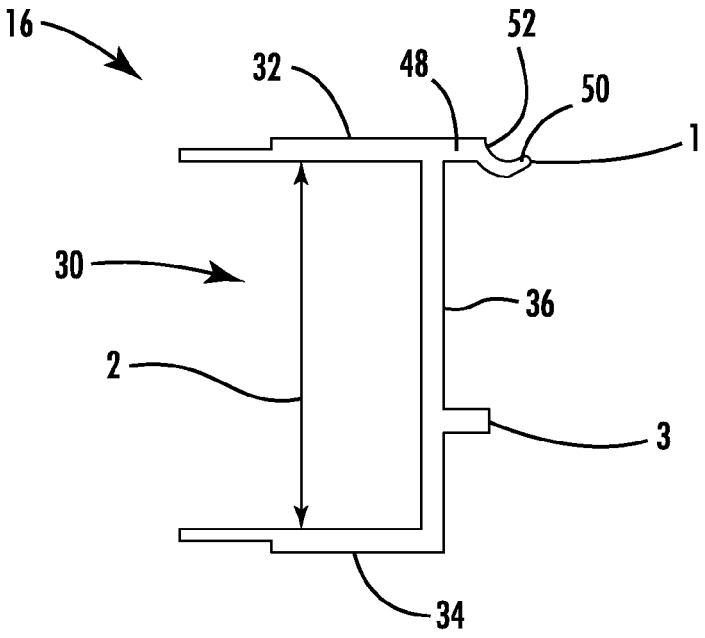
FIG. 1 is a sectional view of an extruded male joint member.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout. As used herein the term "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises," "includes," "comprising," and/or "including," when used in this specification, specify the presence of stated features, integers, steps, operations, elements, and/or components, but do not preclude the presence or addition of one or more other features, integers, steps, operations, elements, components, and/or groups thereof.

It is noted that any one or more aspects or features described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 7:
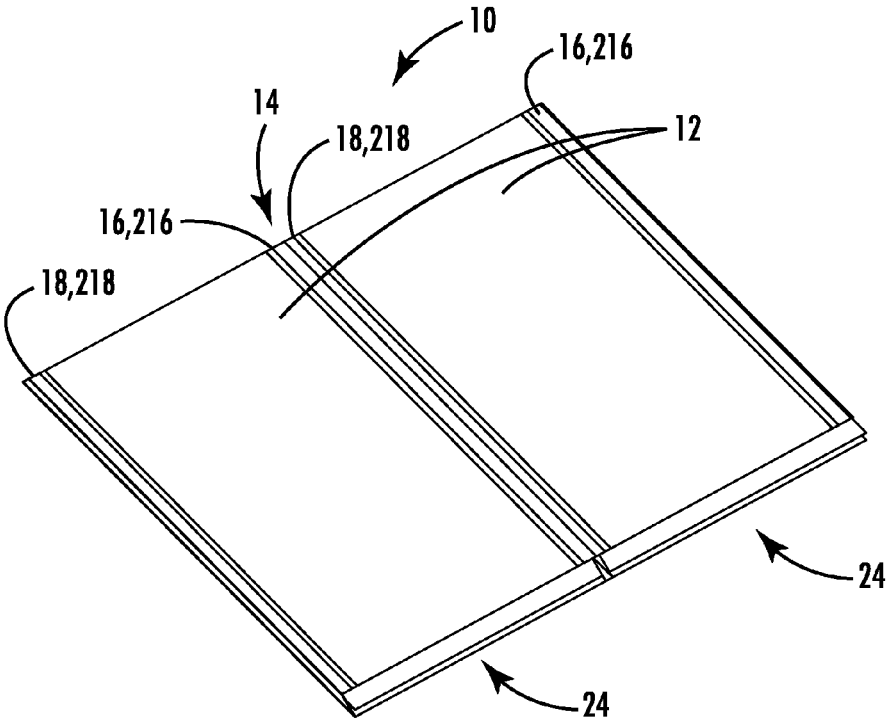
FIG. 7 is a perspective view of two structural panel assemblies including panels that are connected using the male and female joint members of FIGS. 1 and 2.
Figure 8:
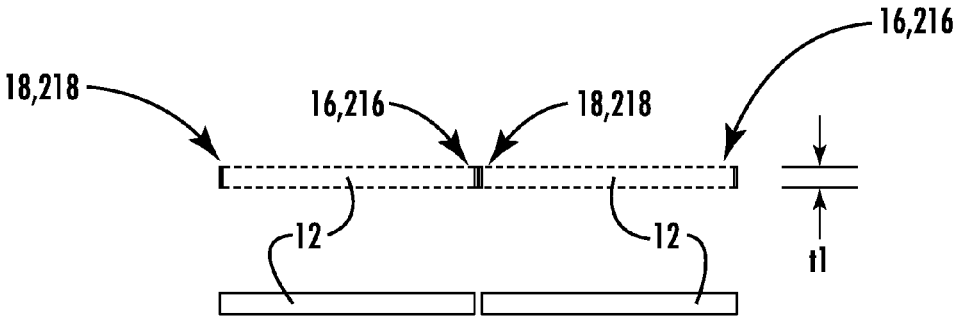
FIG. 8 is a side view of the two structural panel assemblies of FIG. 7.
Figure 9:
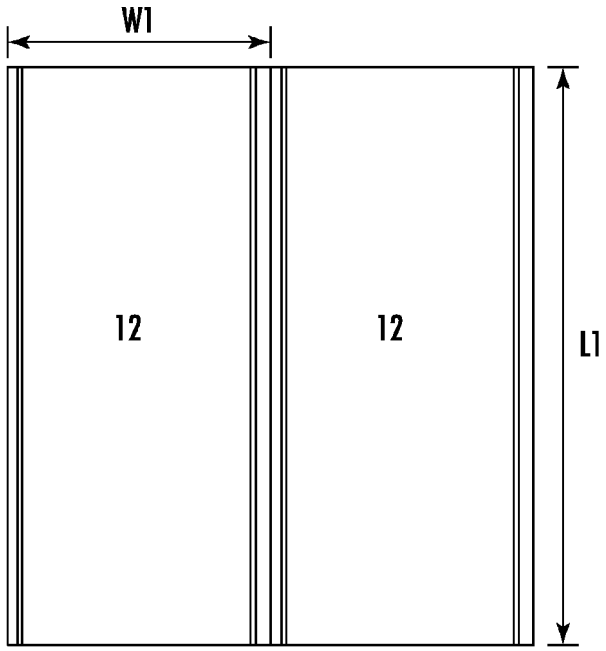
FIG. 9 is a plan view of the two structural panel assemblies of FIG. 7.

A structural assembly 10 is illustrated in FIGS. 7-9. The assembly 10 includes a pair of structural panels 12 that are coupled to one another by a joint assembly 14 that extends along the entire length or substantially the entire length of the panels 12. The joint assembly 14 includes a male joint member 16 and a female joint member 18. As will be described in greater detail below, the joint members 16, 18 are configured to couple to one another to join the panels 12.

A respective panel 12 has a width W1, a length L1 and a depth or thickness t1. The interconnected panels may be used for various applications including, but not limited to, a roof, a wall and a floor. The dimensions of the panel 12 may vary depending on the application. In some embodiments, the panel 12 may have a width W1 between about 2 feet to 4 feet, a thickness t1 between about 2 inches and 8 inches, and/or a length L1 between about 10 feet and 24 feet.

The panel 12 includes a substrate 20 and a laminating sheet 22 on one or both opposing sides of the substrate 20. The substrate 20 is typically formed of a material that has relatively low thermal conductivity while also being relatively lightweight. An exemplary suitable material for the substrate 20 is polystyrene. The sheets 22 are typically formed of a material that provides structural strength to the panel 12 while also be relatively lightweight. An exemplary suitable material for the sheets 22 is aluminum. The sheets 22 may be adhered to the substrate 20 with a suitable adhesive. In some embodiments, the sheets 22 are adhered to the substrate using an International Building Code (IBC) approved structural adhesive that is a high-performance adhesive for adverse conditions.

The sheets 22 may also be in the form of a coating, such as a spray-on protective coating. An exemplary suitable spray-on coating is LINE-X, which is a thermoplastic and polyurea protective coating available from LINE-X, LLC of Huntsville, Ala. The protective coating may be useful to provide bullet and/or shrapnel resistance in military applications, for example.

According to some embodiments, the panel 12 may be a substrate. For example, the panel 12 may be a piece of plywood.

Figure 2:
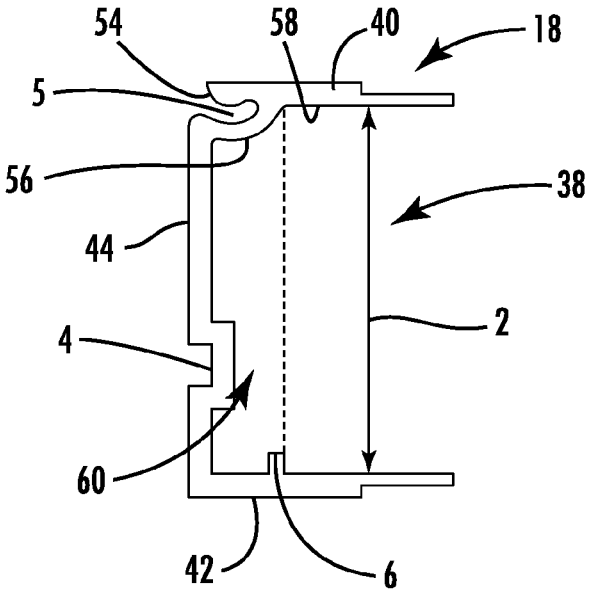
FIG. 2 is a sectional view of an extruded female joint member.
Figure 3:
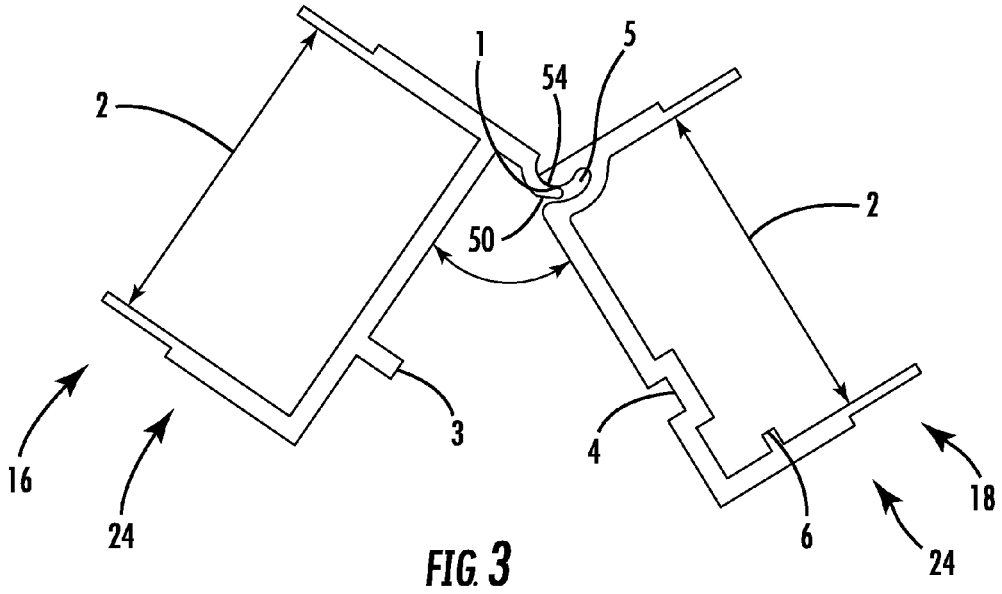
FIG. 3 is a sectional view of the male and female joint members of FIGS. 1 and 2 prior to being fully connected.

Referring to FIGS. 1 and 2, the male joint member 16 includes an upper wall 32, a lower wall 34 and an outer wall 36 that collectively define a longitudinal cavity 30. The cavity 30 is sized and configured to receive and hold the panel 12 at one longitudinal edge portion thereof. Similarly, the female joint member 18 includes an upper wall 40, a lower wall 42 and an outer wall 44 that collectively define a longitudinal cavity 38. The cavity 38 is sized and configured to receive and hold the panel 12 at the opposite longitudinal edge portion thereof. The cavities 30, 38 have a height 2 that generally corresponds to the thickness of the panel 12.

The panel 12 may be received in the cavities 30, 32 with an interference fit. Additionally or alternatively, the male and female joint members 16, 18 may be adhered (or otherwise attached) to the panel using, for example, an IBC approved structural adhesive. In this regard, a panel assembly 24 is provided with the male and female joint members 16, 18 attached to the panel at opposite longitudinal edge portions thereof.

Referring to FIG. 1, extending outwardly from the outer wall 36 of the male joint member 16 is a latch member 1 that extends along the length of the male joint member 16. The latch member 1 includes a straight portion 48 and a curved portion 50. An engagement surface 52 is defined between the straight portion 48 and the curved portion 50. A ledge 3 extends outwardly from the outer wall 36 and extends along the length of the male joint member 16.

Turning to FIG. 2, the female joint member 18 includes a curved channel 5 that is defined between the upper wall 40 and the outer wall 44. The curved channel 5 extends along the length of the female joint member 18. An engagement surface 54 is defined at the end of the upper wall 40 and is adjacent the curved channel 5. The curved channel 5 is sized, shaped and configured to receive the latch member 1 of the male joint assembly 16, as will be described in greater detail below.

A straight channel 4 is defined in the outer wall 44 and extends the length of the female joint member 18. The straight channel 4 is sized and configured to receive the ledge 3 of the male joint assembly 16, as will be described in greater detail below.

A stop ledge 6 extends upwardly from the lower wall 42 into the cavity 38 of the female joint member 18. The curved channel 5 is partially defined by a curved portion 56 that extends to meet a flat portion 58 of the upper wall 40. The stop ledge 6 is generally aligned with the interface of the curved portion 56 and the flat portion 58. The stop ledge 6 may be used to stop the panel 12 as it is slidingly received in the cavity 38. This may help prevent damage to the panel 12 as it may otherwise be deformed between the lower wall 42 and the curved portion 56 of the female joint member 18. A portion 60 of the cavity 38 in which the panel 12 is not received may be filled with, for example, a spray foam that preferably has a low thermal conductivity. Alternatively, the cavity portion 60 may be left unfilled, thereby defining an air gap.

The joint members 16, 18 may be formed of any suitable material that facilitates a strong connection between interconnected panels while also being relatively lightweight. An exemplary suitable material for the joint members is aluminum (e.g., the joint members may be extruded aluminum members).

The panel assemblies 24 are configured to couple to one another end-to-end as will now be described with reference to FIGS. 3-6. The male joint member 16 of one of the panel assemblies 24 is disposed adjacent the female joint member 18 of another one of the panel assemblies 24. A first one of the panel assemblies 24 is rotated or tilted in a first direction relative to a second one of the panel assemblies 24 with the male latch member 1 adjacent the female curved channel 5. The curved portion of the 50 of the male latch member 1 is received against the engagement surface 54 adjacent the female curved channel 5. The first panel assembly 24 is gradually rotated or tilted in a second, opposite direction such that the male latch member 1 is gradually received in the curved female channel 5 to reach the connected or coupled position shown in FIG. 4.

Figure 4:
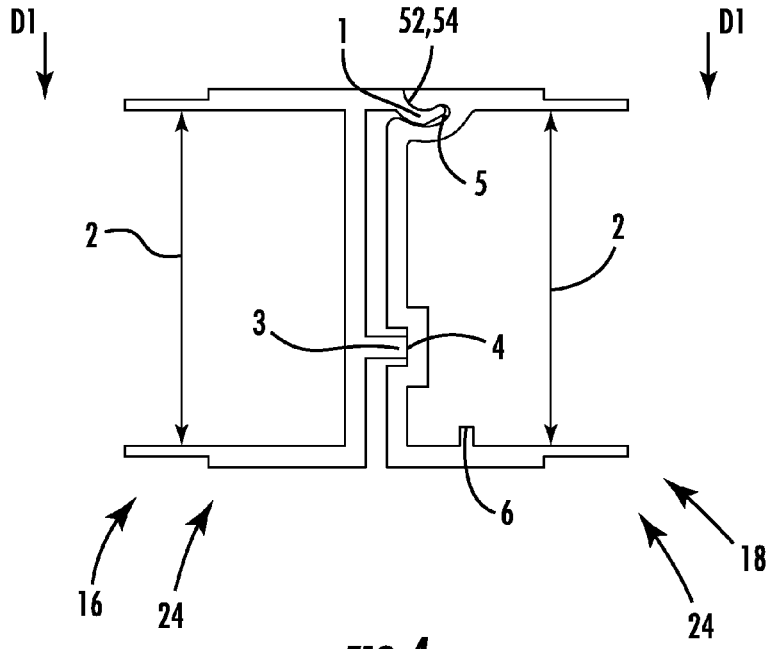
FIG. 4 is a sectional view of the male and female joint members of FIG. 3 in a connected state.
Figure 5:
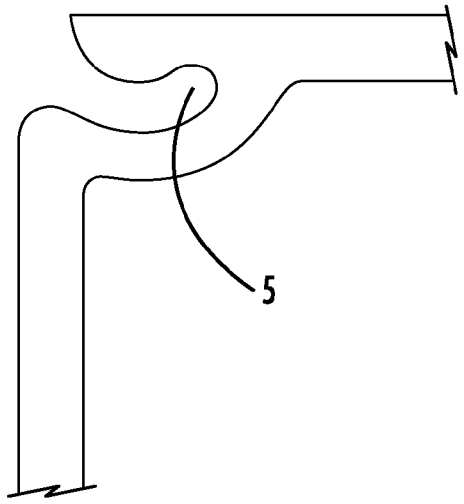
FIG. 5 is an enlarged fragmentary view of a curved channel of the female joint member of FIG. 2.
Figure 6:
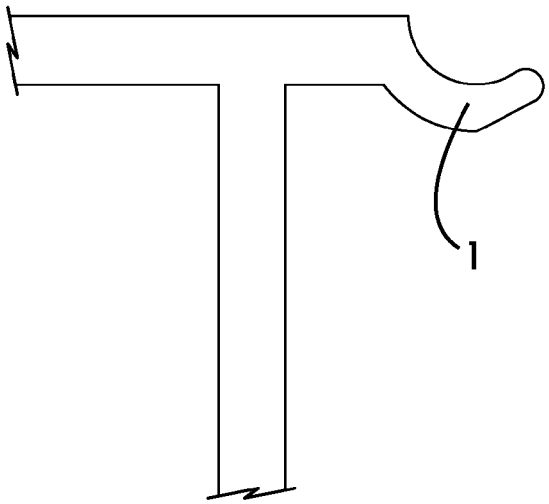
FIG. 6 is an enlarged fragmentary view of a latch member of the male joint member of FIG. 1.

Therefore, one method of connecting the structural panels includes lining an end portion of the latch member 1 with an end (entrance) portion of the curved channel 5, then tilting latch member 1 (or the panel associated therewith) upward such that the latch member 1 is received in the curved channel, and then tilting the latch member 1 (or the panel associated therewith) downward to lock the two joint members together (i.e., in the position shown in FIG. 4).

In the coupled position, an upper portion of the male latch member 1 is received against the upper portion of the female curved channel 5. In addition, the engagement faces 52, 54 are in contact with one another. This provides a seal at the joint interface between the two panel assemblies 24. Further, the ledge 3 is received in the straight channel 4. The engagement of the male latch member 1 and the female curved channel 5 and the engagement of the ledge 3 and the straight channel 4 provide a strong connection of the adjacent panel assemblies 24 that is able to withstand relatively large forces in the direction D1.

Figure 10:
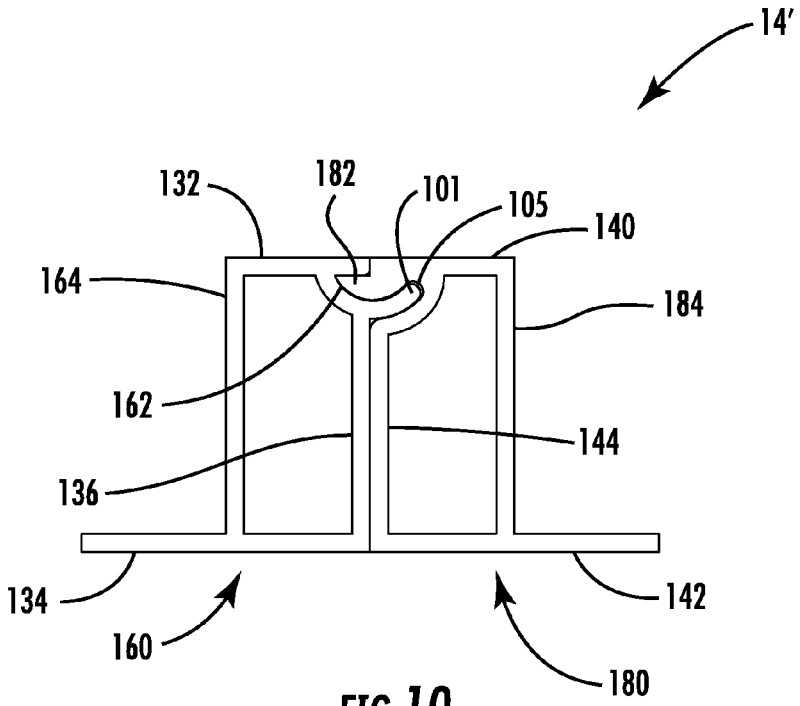
FIG. 10 is a sectional view illustrating an alternative design for the joint members.

An alternative joint assembly 14' according to some embodiments is shown in FIG. 10. The joint assembly 14' includes a first joint member 160 and a second joint member 180. The second joint member 180 includes a curved channel 105 that is sized, shaped and configured to receive a curved latch member 101 of the first joint member 160. The first joint member 160 also includes a channel 162 that is sized, shaped and configured to receive a latch member 182 of the second joint assembly 182. The channel 162 is defined between the curved latch member 105 and an upper wall 132 of the first joint member 180. As illustrated, when connected, an inner wall 136 of the first joint member 160 is adjacent and/or abuts an inner wall 144 of the second joint member 180. Also, an outer wall 164 extends between the lower wall 134 and the upper wall 132 of the first joint member 160 and an outer wall 184 extends between the lower wall 142 and the upper wall 140 of the second joint member 180. The illustrated features, including the "double latch" configuration and the outer and inner walls can provide a strong connection that is sealed at the joint interface. It will be understood that the joint members 160, 180 can be used in place of the joint members 16, 18 described above and can be connected in the same or similar way as described with respect to the joint members 16, 18.

A joint assembly 14" according to some other embodiments is illustrated in FIGS. 11-15. The joint assembly 14" includes a male joint member 216 and a female joint member 218.

Figure 11:
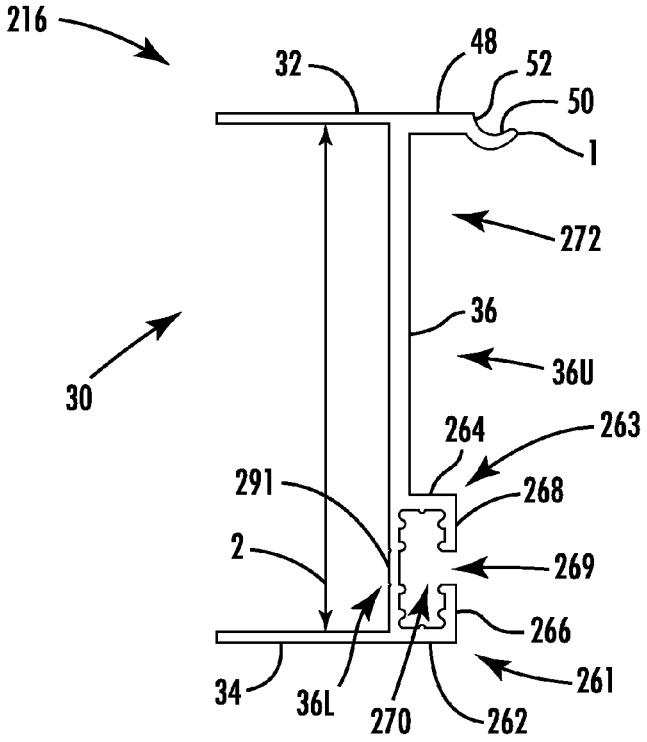
FIG. 11 is a sectional view of an extruded male joint member according to some other embodiments.

Referring to FIG. 11, the male joint member 216 includes an upper wall 32, a lower wall 34 and an outer wall 36 that collectively define a longitudinal cavity 30. The cavity 30 is sized and configured to receive and hold the panel 12 at one longitudinal edge portion thereof (FIGS. 7 and 13). Similarly, referring to FIG. 12, the female joint member 218 includes an upper wall 40, a lower wall 42 and an outer wall 44 that collectively define a longitudinal cavity 38. The cavity 38 is sized and configured to receive and hold the panel 12 at the opposite longitudinal edge portion thereof (FIGS. 7 and 13). The cavities 30, 38 have a height 2 that generally corresponds to the thickness of the panel 12.

The panel 12 may be received in the cavities 30, 32 with an interference fit. Additionally or alternatively, the male and female joint members 216, 218 may be adhered (or otherwise attached) to the panel using, for example, an IBC approved structural adhesive. In this regard, a panel assembly 24 is provided with the male and female joint members 216, 218 attached to the panel(s) 12 at opposite longitudinal edge portions thereof (FIGS. 7 and 13).

Referring to FIG. 11, extending outwardly from the outer wall 36 of the male joint member 216 is a latch member 1 that extends along the length of the male joint member 216. The latch member 1 includes a straight portion 48 and a curved portion 50 (the straight portion 48 may also be considered part of the upper wall 32). An engagement surface 52 is defined between the straight portion 48 and the curved portion 50.

Figure 12:
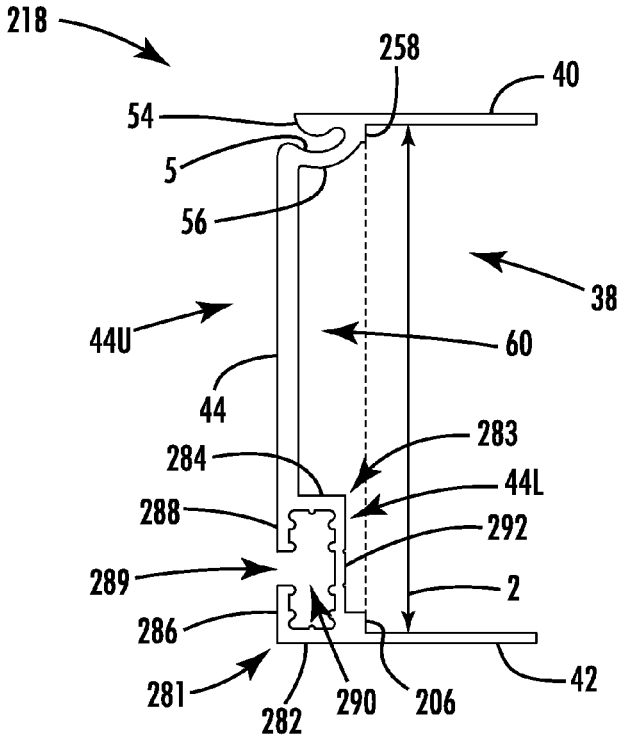
FIG. 12 is a sectional view of an extruded female joint member according to same other embodiments.
Figure 13:
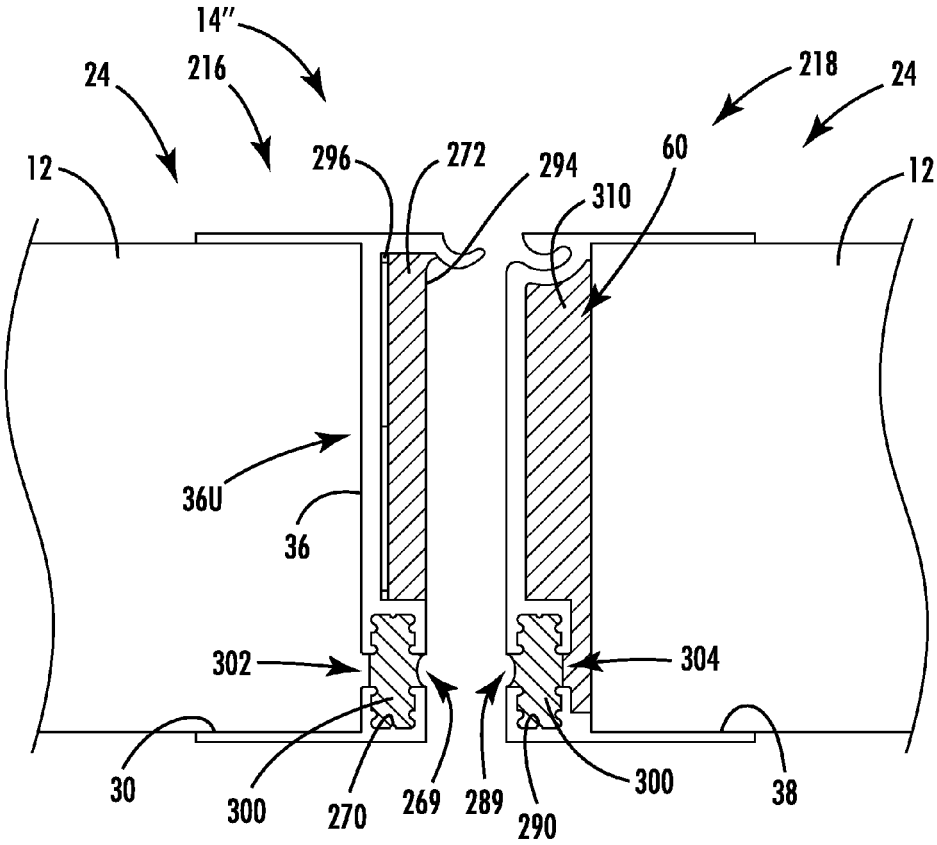
FIG. 13 is a sectional view of the male and female joint members of FIGS. 11 and 12 with additional components attached or coupled thereto including a seal member, thermal break material and the panels of FIGS. 7-9.

Turning to FIG. 12, the female joint member 218 includes a curved channel 5 that is defined between the upper wall 40 and the outer wall 44, The curved channel 5 extends along the length of the female joint member 218. An engagement surface 54 is defined at the end of the upper wall 40 and is adjacent the curved channel 5. The curved channel 5 is sized, shaped and configured to receive the latch member 1 of the male joint assembly 216, as will be described in greater detail below.

A stop step 206 extends upwardly from the lower wall 42 into the cavity 38 of the female joint member 218. The curved channel 5 is partially defined by a curved portion 56 that extends to meet a flat portion 258 adjacent the upper wall 40. The stop step 206 is aligned or generally aligned with the flat portion 258. The stop step 206 and/or the flat portion 258 may be used to stop the panel 12 as it is slidingly received in the cavity 38. This may help prevent damage to the panel 12 as it may otherwise be deformed between the lower wall 42 and the curved portion 56 of the female joint member 218. A portion 60 of the cavity 38 in which the panel 12 is not received may be filled with, for example, a spray foam that preferably has a low thermal conductivity. Additionally or alternatively, at least a portion of the cavity portion 60 may be left unfilled, thereby defining an air gap. For example, spray foam may be applied to each of opposite end portions of the cavity portion 60 and an air gap may be defined between the spray foam in the middle of the cavity portion 60. The spray foam may be omitted in some embodiments.

The joint members 216, 218 may be formed of any suitable material that facilitates a strong connection between interconnected panels while also being relatively lightweight. An exemplary suitable material for the joint members is aluminum (e.g., the joint members may be extruded aluminum members). According to some embodiments, the extruded aluminum may be about ⅛ inches thick, but the extruded aluminum may have a greater or lesser thickness to meet the structural integrity of the application.

It will be appreciated from the above discussion that the joint members 216, 218 share several common features with the joint members 16, 18. The primary differences are described below.

Referring again to FIG. 11, a lower step 261 and an upper step 263 extend outwardly from the outer wall 36 of the male joint member 216. The lower step 261 includes a lower ledge 262 and a lower lip 266 extending upwardly from the lower ledge 262. The upper step 263 includes an upper ledge 264 and an upper lip 268 extending downwardly from the upper ledge 264. A gap 269 is defined between the lower and upper lips 266, 268. A lower portion 36L of the outer wall 36, the lower step 261 and the upper step 263 define a channel 270 that extends the entire length of the male joint member 216. The lower portion 36L of the outer wall 36 may be defined between the lower and upper ledges 262, 264 and an upper portion 36U of the outer wall 36 may be defined between the upper ledge 262 and the upper wall 32. A channel 272 is defined between the upper ledge 264, the outer wall 36 and the upper wall 32 (or the straight portion 48 of the male latch member 1).

Referring again to FIG. 12, a lower step 281 and an upper step 283 extend from the outer wall 44 of the female joint member 218. The lower step 281 includes a lower ledge 282 that extends outwardly from the outer wall 44 and a lower lip 286 extending upwardly from the lower ledge 282. The upper step 283 includes an upper ledge 284 extending inwardly from the outer wall 44 and an upper lip 288 extending downwardly from the upper ledge 284. A gap 289 is defined between the lower and upper lips 286, 288. A lower portion 44L, of the outer wall 44, the lower step 281 and the upper step 283 define a channel 290 that extends the entire length of the female joint member 218. The lower portion 44L of the outer wall 44 may be defined between the lower and upper ledges 282, 284 and an upper portion 44U of the outer wall 44 may be defined between the upper ledge 284 and the upper wall 40.

According to some embodiments, a seal panel 294 is attached to the male joint member 216. Referring to FIG. 13, the seal 294 may be adhered to the outer wall 34. More specifically, the seal 294 may be adhered to the upper portion 34U of the outer wall 34 and may fill the channel 272. The seal 294 extends the entire length or substantially the entire length of the male joint member 216. As described in more detail below, when the male and female joint members 216, 218 are in a connected state, the seal 294 serves to help prevent moisture from penetrating the male and female joint members 216, 218.

The seal 294 may be formed of any suitable material. For example, the seal 294 may be an EPDM closed cell rubber extrusion. The seal 294 may have a hardness of about 70 durometer.

The seal 294 may be adhered to the outer wall 34 using an adhesive or adhesive layer 296. The adhesive 296 may be, for example, a rubber based pressure sensitive adhesive (PSA) (e.g., adhesive sealing tape).

Still referring to FIG. 13, according to some embodiments, the channels 270, 290 of the male and female joint members 216, 218 are filled with a thermal break or thermal bridge material 300. The thermal break material 300 may be a polymer material that is injected as a liquid into the channels 270, 290 through the gaps 269, 289. The liquid polymer material then hardens or solidifies to form the thermal break material 300. In its hardened state, the thermal break material 300 is a strong structural polymer material. According to some embodiments, the thermal break material 300 is or includes polyurethane. The thermal break material 300 extends the entire length or substantially the entire length of the male and female joint members 216, 218.

After the thermal break material 300 hardens, sections 291, 292 of the male and female joint members 216, 218 (FIGS. 11 and 12) are removed (e.g., by cutting). The removal of the sections 291, 292 results in gaps 302, 304 that extend the entire length of the male and female joint members 216, 218. As will be described in more detail below, the gaps 302, 304 interrupt a thermal path along the male and female joint members 216, 218 (which may be metal such as aluminum).

The male and female joint members 216, 218 may be supplied with the thermal break material 30 in the channels 270, 290 and the sections 291, 292 removed to form the gaps 302, 304. A user may then adhere the seal 294 to the male joint member 216. The user may then install the panels 12 such that they are held in the channels 30, 38. According to some embodiments, the user may then apply the spray foam 310 in the cavity portion 60 as described above.

A panel assembly 24 may include the panel 12 with the male and female joint members 216, 218 attached to the panel 12 at opposite longitudinal edge portions thereof. The panel assembly 24 may have the same width W1, length L1 and thickness t1 as the panels 12 and/or panel assemblies 24 described above.

Figure 14:
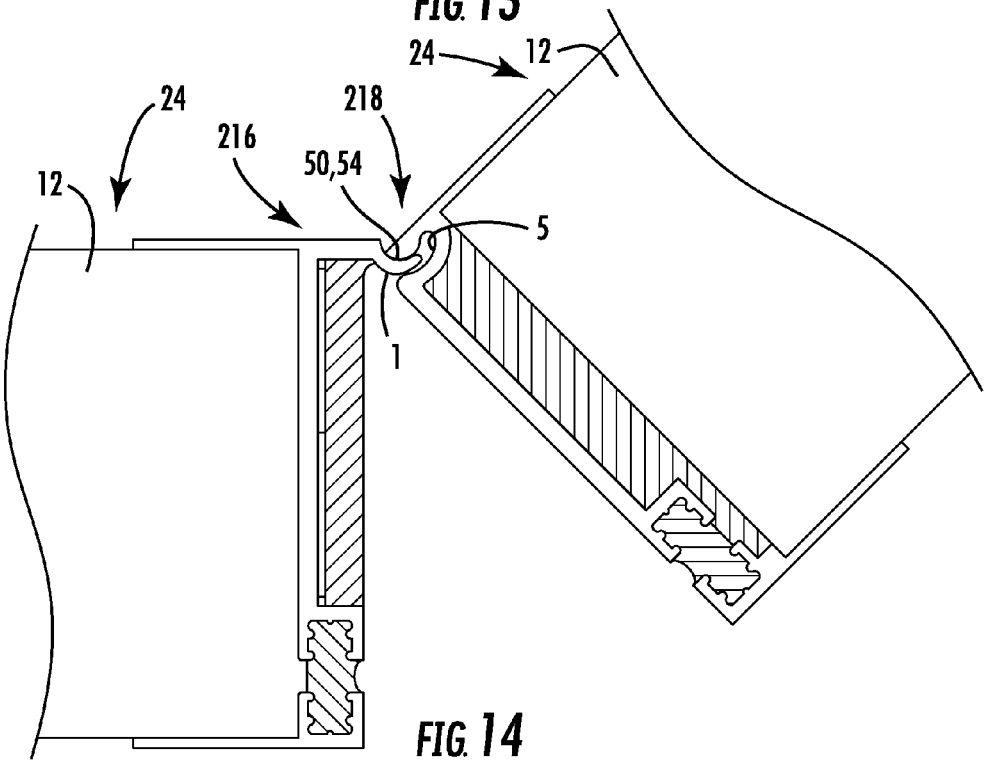
FIG. 14 is a sectional view of the male and female joint members of FIG. 13 prior to being fully connected.

The panel assemblies 24 are configured to couple to one another end-to-end as will now be described with reference to FIGS. 13-15. The male joint member 216 of one of the panel assemblies 24 is disposed adjacent the female joint member 218 of another one of the panel assemblies 24. A first one of the panel assemblies 24 is rotated or tilted in a first direction relative to a second one of the panel assemblies 24 with the male latch member 1 adjacent the female curved channel 5. The curved portion of the 50 of the male latch member 1 is received against the engagement surface 54 adjacent the female curved channel 5. The first panel assembly 24 is gradually rotated or tilted in a second, opposite direction such that the male latch member 1 is gradually received in the curved female channel 5 to reach the connected or coupled position shown in FIG. 15.

Figure 15:
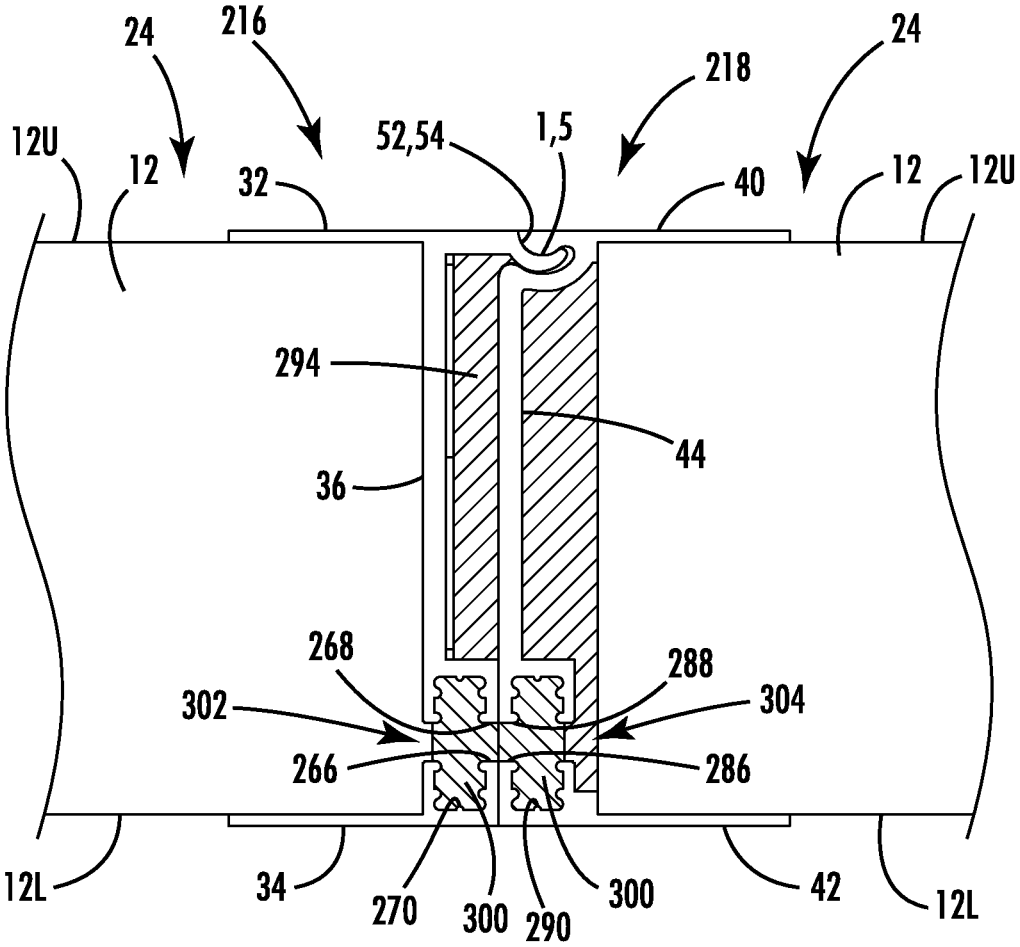
FIG. 15 is a sectional view of the male and female joint members of FIG. 13 in a connected state.

Therefore, one method of connecting the structural panels includes lining an end portion of the latch member 1 with an end (entrance) portion of the curved channel 5, then tilting latch member 1 (or the panel associated therewith) upward such that the latch member 1 is received in the curved channel, and then tilting the latch member 1 (or the panel associated therewith) downward to lock the two joint members together (i.e., in the position shown in FIG. 15).

In the coupled position, an upper portion of the male latch member 1 is received against the upper portion of the female curved channel 5. In addition, the engagement faces 52, 54 are in contact with one another. This provides a seal at the joint interface between the two panel assemblies 24.

In the coupled position shown in FIG. 16, the seal panel 94 is disposed between the outer wall 36 of the male joint member 216 and the outer wall 44 of the female joint member 218. According to some embodiments, the seal 94 is adjacent and/or abuts the outer wall 44 of the female joint member 218 in the coupled position. The seal 94 helps prevent moisture from penetrating through the male and female joint members 216, 218 (e.g., moisture that may have leaked through the coupled latch members 1, 5). The joint member upper walls 32, 40 and upper portions 12U of the panels 12 may be exposed to the elements. For example, the upper walls 32, 40 and the panel upper portions 12U (which may be or include the laminating sheets 22 described above) may be an outer portion of a wall or an upper portion of a roof. The seal 24 advantageously helps prevent moisture from penetrating to the joint member lower walls 34, 42 and/or lower portions 12L of the panels 12 (which may be an inner portion of a wall or a lower portion of a roof). The seal 24 may also provide enhanced thermal resistance between the upper and lower portions of the male and female joint members 216, 218.

Still referring to FIG. 15, the channels 270, 290 of the male and female joint members 216, 218 are adjacent one another in the coupled position. Specifically, the lower lips 266, 268 are adjacent and/or abut one another and the upper lips 268, 288 are adjacent and/or abut one another. The thermal break materials 300 held in each of the channels 270, 290 are adjacent and/or abut one another (e.g., through the gaps 269, 289 shown in FIGS. 11 and 12). The gaps 302, 304 in the male and female joint members 216, 218 help to prevent "sweating" of any condensate or moisture along the extrusion of the male and female joint members 216, 218. That is, the extrusion material (e.g., aluminum) is discontinuous from the upper walls 32, 40 to the lower walls 34, 42 of the male and female joint members 216, 218 due to the gaps 302, 304 to help eliminate a thermal path for condensate or moisture. The thermal break material 300 may also provide enhanced thermal resistance between the upper and lower portions of the male and female joint members 216, 218.

It will be appreciated that additional panel assemblies can be attached end-to-end in the manner described above to provide a structure having the appropriate total width. In some embodiments, the interconnected panel assemblies are used as a roof. For example, the panel assemblies according to embodiments described herein can be used a roof for a portable, expandable structure as described in co-owned U.S. Pat. No. 8,720,126 and U.S. Patent Application Publication No. 2013/0305626, the disclosures of which are incorporated by reference herein in their entireties.

Embodiments of the invention provide a connection mechanism that facilitates easy connection of structural panels without tools. The connection is secure and does not need additional fasteners. The connection and/or the seal panel provide a seal such that sealing tape or the like is not needed at the joint between the structural panels. The panels can be easily disconnected using an opposite method as that described above. Therefore, the panels can be reused many times. The panels may be useful for structures such as roofs that need to be constructed quickly but still require high strength and thermal insulation.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the teachings and advantages of this invention. Accordingly, all such modifications are intended to be included within the scope of this invention as defined in the claims. The invention is defined by the following claims, with equivalents of the claims to be included therein.

That which is claimed is:

1. A structural panel assembly comprising:

first and second structural panels each comprising:

a substrate;

an elongated male joint member comprising an aluminum extrusion at a first longitudinal edge portion of the substrate, the male joint member comprising a latch member comprising a curved portion that extends the length of the substrate; and an elongated female joint member comprising an aluminum extrusion at a second, opposite longitudinal edge portion of the substrate, the female joint member comprising a curved channel that extends the length of the substrate;

wherein the curved channel of the female joint member of the first structural panel is sized and configured to receive the latch member of the male female joint member of the second structural panel with the first and second structural panels in a coupled position with the second longitudinal edge portion of the substrate of the first structural panel parallel to the first longitudinal edge portion of the substrate of the second structural panel;

wherein:

the male joint member comprises an upper wall, a lower wall, an outer wall extending between the upper wall and the lower wall, and a channel at a lower portion of the outer wall;

the female joint member comprises an upper wall, a lower wall, an outer wall extending between the upper wall and the lower wall, and a channel at a lower portion of the outer wall;

the male joint member comprises a seal panel adhered to the outer wall of the male joint member;

the seal panel is disposed between the outer wall of the first structural panel female joint member and the outer wall of the second structural panel male joint member in the coupled position;

the channel of the first structural panel female joint member and the channel of the second structural panel male joint member are adjacent one another in the coupled position; and the channels of each of the male and female joint members are filled with thermal break material.

2. The assembly of claim 1 wherein the seal panel abuts the outer wall of the first structural female joint member in the coupled position.

3. The assembly of claim 1 wherein the seal panel comprises EPDM rubber.

4. The assembly of claim 1 wherein a gap is formed in the lower portion of the outer wall of each of the male and female joint members.

5. A structural panel assembly comprising:

first and second structural panels each comprising:

a substrate;

an elongated male joint member comprising an aluminum extrusion at a first longitudinal edge portion of the substrate, the male joint member comprising a latch member comprising a curved portion that extends the length of the substrate; and an elongated female joint member comprising an aluminum extrusion at a second, opposite longitudinal edge portion of the substrate, the female joint member comprising a curved channel that extends the length of the substrate;

wherein the curved channel of the female joint member of the first structural panel is sized and configured to receive the latch member of the male female joint member of the second structural panel with the first and second structural panels in a coupled position with the second longitudinal edge portion of the substrate of the first structural panel parallel to the first longitudinal edge portion of the substrate of the second structural panel;

wherein:

the male joint member comprises an upper wall and a lower wall with an outer wall extending therebetween;

the female joint member comprises an upper wall and a lower wall with an outer wall extending therebetween;

the male joint member comprises a seal panel adhered to the outer wall of the male joint member;

the seal panel is disposed between the outer wall of the first structural panel female joint member and the outer wall of the second structural panel male joint member in the coupled position;

the male joint member comprises an upper ledge extending outwardly from the outer wall between an upper portion of the outer wall and a lower portion of the outer wall, an upper lip extending downwardly from the upper ledge, a lower ledge extending outwardly from the outer wall and spaced apart from the upper ledge, and a lower lip extending upwardly from the lower ledge;

the female joint member outer wall comprises a step between an upper portion of the outer wall and a lower portion of the outer wall, the female joint member further comprising an upper lip extending downwardly from the upper portion of the outer wall, a lower ledge extending outwardly from the lower portion of the outer wall and spaced apart from the step, and a lower lip extending upwardly from the lower ledge;

the upper lips of the first structural panel female joint member and the second structural panel male joint member are adjacent and/or abutting in the coupled position; and the lower lips of the first structural panel female joint member and the second structural panel male joint member are adjacent and/or abutting in the coupled position.

6. The assembly of claim 5 wherein:

the male joint member comprises a channel defined by the lower portion of the outer wall, the upper ledge, the upper lip, the lower ledge, and the lower lip;

the female joint member comprises a channel defined by the step, the lower portion of the outer wall, the upper lip, the lower ledge, and the lower lip; and the channel of the first structural panel female joint member and the channel of the second structural panel male joint member are adjacent one another in the coupled position.

7. The assembly of claim 6 wherein the channels of each of the male and female joint members are filled with thermal break material.

8. The assembly of claim 7 wherein a gap is formed in the lower portion of the outer wall of each of the male and female joint members.

* * * * *